US009867465B2

(12) United States Patent
Hsu et al.

(10) Patent No.: US 9,867,465 B2
(45) Date of Patent: Jan. 16, 2018

(54) SYSTEM AND METHOD FOR ADJUSTING SEAT HEIGHT OF CHAIR

(71) Applicant: HON HAI PRECISION INDUSTRY CO., LTD., New Taipei (TW)

(72) Inventors: Hsin-Wen Hsu, New Taipei (TW); Yi-Chien Tsai, New Taipei (TW); Hsiao-Ping Chiu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 161 days.

(21) Appl. No.: 14/792,032

(22) Filed: Jul. 6, 2015

(65) Prior Publication Data

US 2016/0120318 A1 May 5, 2016

(30) Foreign Application Priority Data

Nov. 5, 2014 (TW) ..... 103138446 A

(51) Int. Cl.
*A47C 3/20* (2006.01)
*A47C 31/12* (2006.01)

(52) U.S. Cl.
CPC ..... *A47C 3/20* (2013.01); *A47C 31/126* (2013.01)

(58) Field of Classification Search
CPC ..... A47C 3/20; A47C 31/126
USPC ..... 297/217.2, 217.3, 344.12
See application file for complete search history.

(56) References Cited

U.S. PATENT DOCUMENTS

| | | | | |
|---|---|---|---|---|
| 7,540,565 | B2 * | 6/2009 | Lipford | A61G 5/14 297/284.3 |
| 2005/0088129 | A1 * | 4/2005 | Robert | B60N 2/0244 318/466 |
| 2008/0197677 | A1 * | 8/2008 | Nivet | B60N 2/0244 297/68 |

* cited by examiner

*Primary Examiner* — Milton Nelson, Jr.
(74) *Attorney, Agent, or Firm* — ScienBiziP, P.C.

(57) ABSTRACT

In a seat height adjustment method for a chair, a body height of a user of an electronic device is acquired from the electronic device which is in communication with the chair. The method further computes a target seat height suitable for the user according to the user's body height and a preset formula. The lifting device can automatically adjust the seat height for a user when the user has leave the chair and further returning the seat of the chair to an original height.

6 Claims, 3 Drawing Sheets

SYSTEM AND METHOD FOR ADJUSTING SEAT HEIGHT OF CHAIR

CROSS-REFERENCE TO RELATED APPLICATIONS

This application claims priority to Taiwan Patent Application No. 103138446 filed on Nov. 5, 2014, the contents of which are incorporated by reference herein.

FIELD

The subject matter herein generally relates to height adjustment technology, and particularly to system and method for adjusting a seat height of a chair.

BACKGROUND

General, a seat height of a chair in a public place (for example, a classroom or a library) is fixed. Even if adjustable, a user needs to adjust the seat height manually. The seat height cannot be adjusted automatically to be suitable for different users.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
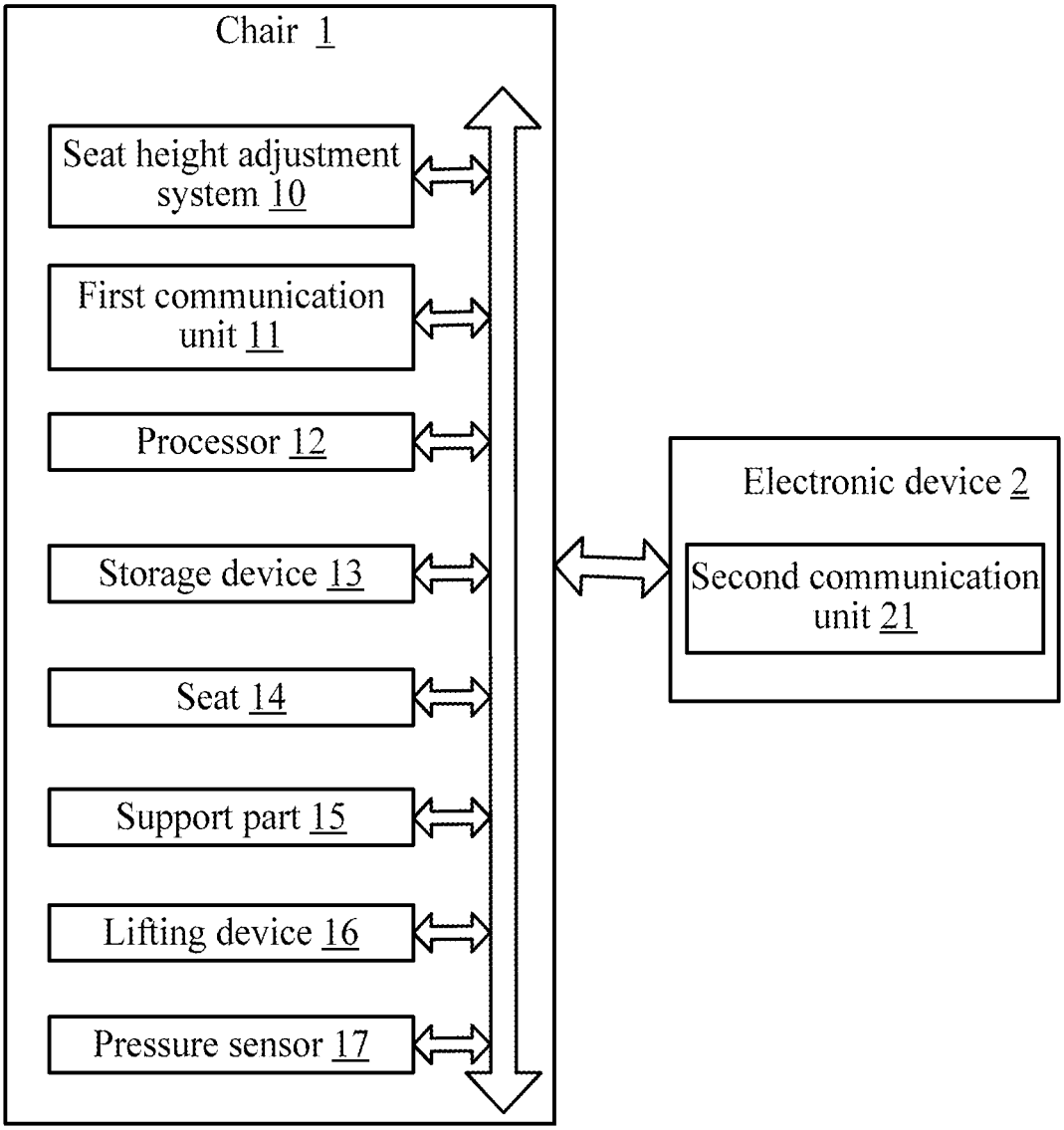
FIG. 1 is a block diagram of an example embodiment of a chair in communication with an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented. The term "module" refers to logic embodied in computing or firmware, or to a collection of software instructions, written in a programming language, such as, Java, C, or assembly. One or more software instructions in the modules can be embedded in firmware, such as in an erasable programmable read only memory (EPROM). The modules described herein can be implemented as either software and/or computing modules and can be stored in any type of non-transitory computer-readable medium or other storage device. Some non-limiting examples of non-transitory computer-readable media include CDs, DVDs, BLU-RAY™, flash memory, and hard disk drives. The term "comprising" means "including, but not necessarily limited to"; it specifically indicates open-ended inclusion or membership in a so-described combination, group, series, and the like.

FIG. 1 illustrates a block diagram of an example embodiment of a chair. In at least one embodiment as shown in FIG. 1, a chair 1 can include, but is not limited to, a seat height adjustment system 10, a first communication unit 11, at least one processor 12, a storage device 13, a seat 14, a support part 15, a lifting device 16, and a pressure sensor 17. FIG. 1 illustrates only one example of the chair 1, other examples can comprise more or fewer components than those shown in the embodiment, or have a different configuration of the various components.

The at least one processor 12 executes one or more computerized codes and other applications of the chair 1 to provide functions of the chair 1. The storage device 13 is a non-transitory computer-readable medium and can be an internal storage device, such as a random access memory (RAM) for temporary storage of information, and/or a read only memory (ROM) for permanent storage of information. The storage device 13 can also be an external storage device, such as an external hard disk, a storage card, or a data storage medium.

In at least one embodiment, the lifting device 16 is positioned between the seat 14 and the support part 15. The lifting device 16 is configured to lift or lower the seat 14 for adjusting a seat height (a height between the seat 14 and a surface on which the chair is positioned) of the chair 1. The chair 1 has an original seat height. The lifting device 16 can be a hydraulic lift, or a spring lift, for example. The pressure sensor 17 is positioned between the seat 14 and the support part 15, and detects a downward pressure of the seat 14.

In at least one embodiment, the chair 1 may wirelessly communicate with an electronic device 2 through the first communication unit 11 and a second communication unit 21 in the electronic device 2. Each of the first communication unit 11 and the second communication unit 21 may be a BLUETOOTH™ module, a near field communication (NFC) device, or a wireless card, for example. In at least one embodiment, the electronic device 2 stores a body height of a user of the electronic device 2. In other embodiments, the electronic device 2 can measure and store the body height of the user by a measuring device/system of the electronic device 2.

Figure 2:
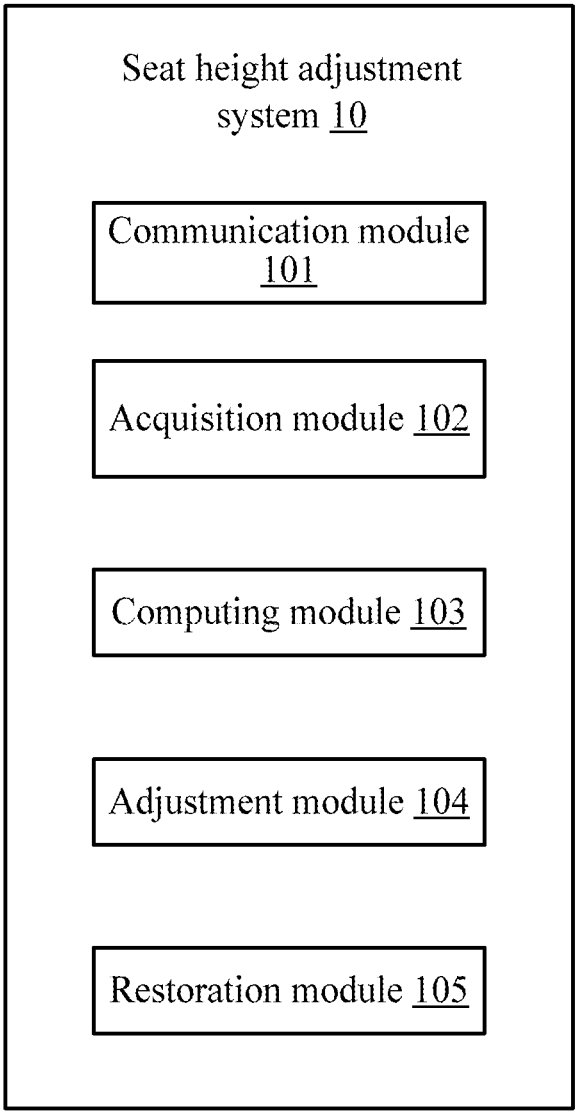
FIG. 2 is a block diagram of an example embodiment of a seat height adjustment system of the chair of FIG. 1.

FIG. 2 illustrates a block diagram of an example embodiment of a seat height adjustment system in the chair of FIG. 1. In at least one embodiment, the seat height adjustment system 10 can include, but is not limited to, a communication module 101, an acquisition module 102, a computing module 103, an adjustment module 104, and a restoration module 105. The modules 101-105 can include computerized instructions in the form of one or more computer-readable programs that can be stored in a non-transitory computer-readable medium, such as the storage device 13, and be executed by the at least one processor 12 of the chair 1. In at least one embodiment, the seat height adjustment system 10 can adjust the seat height of the chair automatically according to the body height of the user, from the electronic device 2, by the abovementioned modules.

The communication module 101 enables the first communication unit 11 to communicate with the second communication unit 21 of the electronic device 2. In other embodiments, when a distance between the chair 1 and the electronic device 2 is less than a preset distance (10 centimeters), the first communication unit 11 (for example, a first NFC device) can match and communicate with the second communication unit 21 (for example, a second NFC device) automatically.

The acquisition module 102 acquires a body height of a user of the electronic device 2 from the electronic device 2. In at least one embodiment, after the chair 1 is in communication with the electronic device 2 through the first communication unit 11 and the second communication unit 21, the acquisition module 102 can automatically acquire the body height of the user from the electronic device 2. For example, the electronic device 2 can include an NFC label which stores data of the body height. When the distance between the chair 1 and the electronic device 2 is less than a preset distance (10 centimeters), the acquisition module 102 can acquire the body height from the NFC label automatically.

In other embodiments, the electronic device 2 can include a measuring device for measuring the body height of the user. After the chair 1 is in communication with the electronic device 2, the acquisition module 102 sends a message to the electronic device 2 for prompting the user of the electronic device 2 to provide the body height of the user, by measuring if necessary. The acquisition module 102 receives the body height of the user from the electronic device 2.

In a further embodiment, when the chair 1 is in communication with the electronic device 2, the acquisition module 102 can send a preset command to the electronic device 2 for controlling the electronic device 2 to provide a pop-up window for inputting body height data. The acquisition module 102 acquires the body height of the user input by the electronic device 2.

The computing module 103 computes a target seat height of the chair suitable for the user according to the acquired body height of the user. In at least one embodiment, the computing module can compute the target seat height by using a preset formula and the acquired body height. For example, the preset formula can be "$Y1=H\times0.2298+2$". In the preset formula, "Y1" represents the target seat height, and "H" represents the body height.

The adjustment module 104 controls the lifting device 16 to adjust the seat height of the chair 1 to be equal to the target seat height according to the target seat height and the original seat height. In at least one embodiment, the adjustment module 104 can calculate a difference between the target seat height "Y1" and the original seat height, represented by "Y0", by subtracting the original seat height from the target seat height, that is, the adjustment module 104 establishes the difference "Y" by applying the formula of "$Y=Y1-Y0$". If the difference "Y" is a positive, the adjustment module 104 controls the lifting device 16 to move the seat 14 upward. If the difference "Y" is a negative, the adjustment module 104 controls the lifting device 16 to move the seat 14 downward.

The restoration module 105 determines if the user is not on the chair 1. In at least one embodiment, the restoration module 105 can acquire a downward pressure on the seat 14 detected by the pressure sensor 17. If the acquired downward pressure is equal to or greater than a preset pressure (for example, 200 Newtons), that is, the user is seated on the seat 14, and the restoration module 105 will so determine. If the acquired downward pressure is less than the preset pressure, that is, the user leaves the seat 14, the restoration module 105 determines that the user is no longer seated on the chair 1.

In other embodiments, the restoration module 105 can further determine when the user leaves the chair 1 for a period (for example, 1 minute) which is preset. The restoration module 105 can determine the length of time following a change in the acquired downward pressure. If the acquired downward pressure becomes less than the preset pressure for the preset time period, the restoration module 105 determines that the user has left the chair 1 permanently. If the acquired downward pressure becomes less than the preset pressure but for less than the preset time period, the restoration module 105 determines that the user is still using the chair 1.

After the user has left or is determined to have permanently left the chair 1, the restoration module 105 controls the lifting device 16 to adjust the seat height of the chair 1 to be the original seat height.

Figure 3:
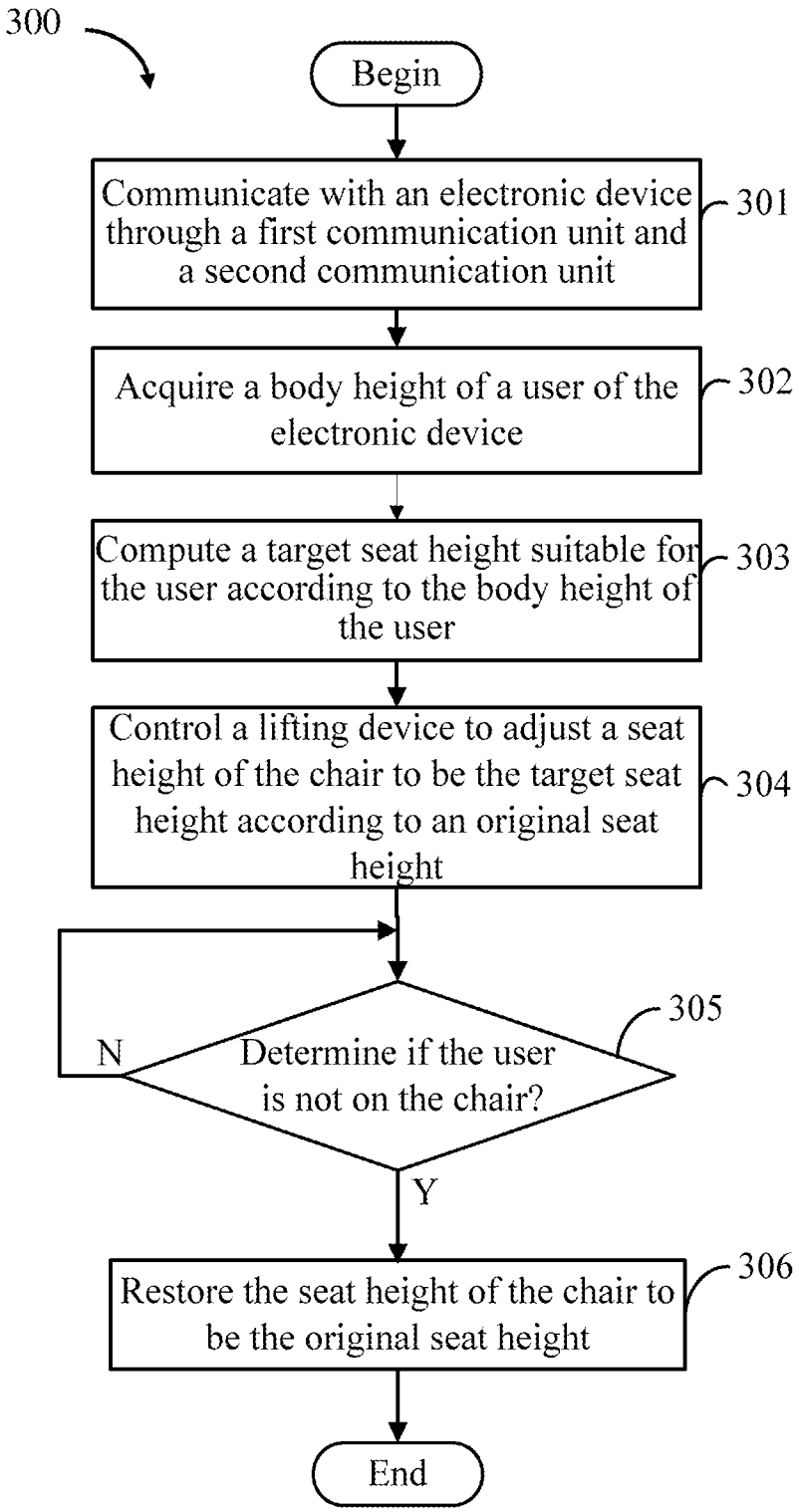
FIG. 3 is a flowchart of an example embodiment of a method for adjusting a seat height of the chair of FIG. 1.

Referring to FIG. 3, a flowchart is presented in accordance with an example embodiment. An example method 300 is provided by way of example, as there are a variety of ways to carry out the method. The example method 300 described below can be carried out using the configurations illustrated in FIGS. 1-2, for example, and various elements of these figures are referenced in explaining the example method 300. Each block shown in FIG. 3 represents one or more processes, methods, or subroutines, carried out in the example method 300. Furthermore, the illustrated order of blocks is illustrative only and the order of the blocks can be changed. Additional blocks can be added or fewer blocks can be utilized without departing from this disclosure. The example method 300 can begin at block 301.

At block 301, a communication module enables the first communication unit 11 to communicate with the second communication unit 21 of the electronic device 2. In other embodiments, when a distance between the chair 1 and the electronic device 2 is less than a preset distance (10 centimeters), the first communication unit 11 (for example, a first NFC device) can match and communicate with the second communication unit 21 (for example, a second NFC device) automatically.

At block 302, an acquisition module acquires a body height of a user of the electronic device 2 from the electronic device 2. In at least one embodiment, when the chair 1 is in communication with the electronic device 2 through the first communication unit 11 and the second communication unit 21, the acquisition module can automatically acquire the body height of the user stored in the electronic device 2.

At block 303, a computing module computes a target seat height of the chair suitable for the user according to the acquired body height of the user. In at least one embodiment, the computing module can compute the target seat height by using a preset formula and the acquired body height. For example, the preset formula can be "$Y1=H\times0.2298+2$". In the preset formula, "Y1" represents the target seat height, and "H" represents the body height.

At block 304, an adjustment module controls the lifting device 16 to adjust the seat height of the chair 1 to the target seat height according to the target seat height and the original seat height of the chair 1. In at least one embodiment, the adjustment module can calculate a difference between the target seat height and the original seat height by subtracting the original seat height from the target seat height. If the difference is a positive number, the adjustment module controls the lifting device 16 to move the seat 14 upward. If the difference is a negative number, the adjustment module 104 controls the lifting device 16 to move the seat 14 downward.

At block 305, a restoration module determines if the user is not on the chair 1. In at least one embodiment, the restoration module can acquire a downward pressure of the seat 14 detected by the pressure sensor 17. If the acquired downward pressure is equal to or greater than a preset pressure (for example, 200 Newtons), the restoration module determines that the user is sitting in the chair 1, and block 305 is repeated. If the acquired downward pressure becomes less than the preset pressure, the restoration module determines that the user has left the chair 1, and block 306 is implemented.

At block 306, the restoration module controls the lifting device 16 to adjust the seat height of the chair 1 to be the original seat height.

All of the processes described above can be embodied in, and fully automated via, functional code modules executed by one or more general purpose processors such as the processor 12. The code modules can be stored in any type of non-transitory readable medium or other storage device such as the storage device 13. Some or all of the methods can alternatively be embodied in specialized hardware. Depending on the embodiment, the non-transitory readable medium can be a hard disk drive, a compact disc, a digital versatile disc, a tape drive, or other storage medium.

The described embodiments are merely examples of implementations, and have been set forth for a clear understanding of the principles of the present disclosure. Variations and modifications can be made without departing substantially from the spirit and principles of the present disclosure. All such modifications and variations are intended to be included within the scope of this disclosure and the described inventive embodiments, and the present disclosure is protected by the following claims and their equivalents.

What is claimed is:

1. A chair comprising:

a lifting device that adjusts a seat height of the chair;

at least one processor coupled to the lifting device; and a storage device that stores one or more programs which, when executed by the at least one processor, cause the at least one processor to:

acquire a body height of a user of an electronic device from the electronic device which is configured to communicate with the chair;

compute a target seat height of the chair suitable for the user according to a body height as received from the electronic device and a preset formula; and control the lifting device to adjust the seat height to be the target seat height.

2. The chair of claim 1, wherein the at least one processor further:

determines if the user is not on the chair; and controls the lifting device to restore the seat height of the chair to be the original seat height when the user is not on the chair.

3. The chair of claim 1, wherein the seat height is adjusted to be the target seat height by:

calculating a difference height between the target seat height and an original seat height of the chair by subtracting the original seat height from the target seat height;

controlling the lifting device to move a seat of the chair upward with a number of the difference height, when the difference height is a positive; and controlling the lifting device to move the seat of the chair downward with the number of the difference height when the difference height is a negative.

4. The chair of claim 1, wherein the at least one processor determines if the user is not on the chair by:

detecting a downward pressure of the seat by a pressure sensor of the chair;

determining that the user does not leave the chair when the acquired downward pressure is greater than a preset pressure; and determining that the user leaves the chair when the acquired downward pressure is less than or equal to the preset pressure.

5. The chair of claim 1, wherein the at least one processor further acquires the body height of the user from the electronic device automatically when the chair communicates with the electronic device.

6. The chair of claim 1, wherein the at least one processor acquires the body height of the user from the electronic device by:

sending a message to the electronic device for prompting the user of the electronic device to measure and provide the body height of the user, or sending a preset command to the electronic device for controlling the electronic device to provide a pop-up window for inputting the data of the body height; and receiving the body height of the user from the electronic device.

* * * * *